US007109924B2

(12) United States Patent
Vance

(10) Patent No.: US 7,109,924 B2
(45) Date of Patent: Sep. 19, 2006

(54) MULTI-BAND ANTENNA SYSTEMS INCLUDING A PLURALITY OF SEPARATE LOW-BAND FREQUENCY ANTENNAS, WIRELESS TERMINALS AND RADIOTELEPHONES INCORPORATING THE SAME

(75) Inventor: Scott L. Vance, Cary, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 128 days.

(21) Appl. No.: 10/848,026

(22) Filed: May 18, 2004

(65) Prior Publication Data

US 2005/0259011 A1 Nov. 24, 2005

(51) Int. Cl.
*H01Q 1/38* (2006.01)
*H01Q 1/24* (2006.01)
*H01Q 3/24* (2006.01)

(52) U.S. Cl. ..... 343/700 MS; 343/702

(58) Field of Classification Search ..... 343/700 MS, 343/702, 815, 876
See application file for complete search history.

(56) References Cited

U.S. PATENT DOCUMENTS 6,295,030 B1 * 9/2001 Kozakai et al. ..... 343/700 MS
6,734,825 B1 * 5/2004 Guo et al. ..... 343/700 MS
6,806,835 B1 * 10/2004 Iwai et al. ..... 343/702

* cited by examiner

*Primary Examiner*—Shih-Chao Chen
(74) *Attorney, Agent, or Firm*—Myers Bigel Sibley & Sajovec, P.A.

(57) ABSTRACT

A multi-band antenna system for a wireless terminal can include a first low-band antenna that configured to resonate in response to first electromagnetic radiation in a low-band frequency range in an active state and a second antenna, that is separate from the first low-band antenna, and is configured to resonate in response to second electromagnetic radiation in the low-band frequency range in the active state.

28 Claims, 13 Drawing Sheets

MARKER 1 = 824 MHz
MARKER 2 = 960 MHz
MARKER 3 = 1710 MHz
MARKER 4 = 1990 MHz

MARKER 1 = 824 MHz
MARKER 2 = 960 MHz
MARKER 3 = 1710 MHz
MARKER 4 = 1990 MHz

MARKER 1 = 824 MHz
MARKER 2 = 894 MHz
MARKER 3 = 1710 MHz
MARKER 4 = 1990 MHz

MARKER 1 = 869 MHz
MARKER 2 = 960 MHz
MARKER 3 = 1710 MHz
MARKER 4 = 1990 MHz

MARKER 1 = 824 MHz
MARKER 2 = 960 MHz
MARKER 3 = 1710 MHz
MARKER 4 = 1990 MHz

| 3 elevation Gain | | Frequency (GHz) | | | | | | | | | | | | Gain | | Efficiency | |
|---|---|---|---|---|---|---|---|---|---|---|---|---|---|---|---|---|---|
| Sample | | 0.82 | 0.85 | 0.87 | 0.89 | 0.93 | 0.96 | 1.71 | 1.79 | 1.85 | 1.91 | 1.93 | 1.99 | Low | High | Low | High |
| Quad - 2nd Low-band element on side | Peak | -3.4 | -1.9 | -1.6 | -0.4 | -0.3 | -2.3 | 1.2 | 2.0 | 0.5 | 1.6 | 1.4 | -0.7 | -1.30 | 1.13 | | |
| | Ave | -6.5 | -5.3 | -5.1 | -3.8 | -3.7 | -5.5 | -4.3 | -2.9 | -3.4 | -2.1 | -2.3 | -4.3 | -4.68 | -3.09 | 0.34 | 0.49 |
| Quad - 2nd Low-band element on bottom | Peak | -1.1 | -0.9 | -1.3 | -0.5 | -0.4 | -2.2 | 1.3 | 1.7 | 0.0 | 0.8 | 0.9 | -0.3 | -0.96 | 0.76 | | |
| | Ave | -4.6 | -4.2 | -4.6 | -3.8 | -3.9 | -5.7 | -4.5 | -3.3 | -4.2 | -3.0 | -2.9 | -4.3 | -4.32 | -3.65 | 0.37 | 0.43 |
| T637 Baseline | Peak | -1.9 | -1.1 | -0.9 | -1.6 | -2.6 | -5.0 | 1.9 | 2.0 | 1.0 | 1.5 | 1.2 | 0.0 | -1.36 | 1.74 | | |
| | Ave | -5.0 | -4.4 | -4.3 | -5.2 | -6.3 | -8.8 | -4.1 | -3.0 | -3.2 | -2.3 | -2.5 | -3.9 | -4.71 | -3.21 | 0.34 | 0.48 |
| Switched (switch open) | Peak | -5.0 | -3.8 | -2.9 | -0.7 | 0.0 | -2.9 | 1.6 | 1.7 | 0.8 | 1.5 | 1.6 | 0.5 | -1.14 | 1.46 | | |
| | Ave | -8.2 | -6.9 | -6.1 | -3.9 | -3.3 | -6.2 | -4.3 | -3.2 | -3.3 | -2.3 | -2.2 | -3.5 | -4.40 | -3.31 | 0.36 | 0.47 |
| Switched (switch closed) low-band on side | Peak | -2.9 | -1.6 | -1.3 | -0.2 | -0.2 | -2.5 | -1.6 | 1.8 | 0.9 | 1.3 | 1.2 | -0.2 | -1.09 | 0.97 | | |
| | Ave | -6.1 | -4.8 | -4.6 | -3.6 | -3.7 | -5.8 | -7.2 | -3.2 | -3.5 | -2.7 | -2.6 | -3.9 | -4.48 | -3.86 | 0.36 | 0.41 |
| Switched performance with low-band on bottom (estimated) | Peak | -1.1 | -0.9 | -1.3 | -0.5 | -0.4 | -2.2 | 1.6 | 1.7 | 0.8 | 1.5 | 1.6 | 0.5 | -0.92 | 1.46 | | |
| | Ave | -4.6 | -4.2 | -4.6 | -3.8 | -3.9 | -5.7 | -4.3 | -3.2 | -3.3 | -2.3 | -2.2 | -3.5 | -4.31 | -3.31 | 0.37 | 0.47 |

FIGURE 13

MARKER 1 = 824 MHz
MARKER 2 = 960 MHz
MARKER 3 = 1710 MHz
MARKER 4 = 1990 MHz

| 3 elevation Gain | | Frequency | | | | | | | | | | | | Gain | | Efficiency | |
|---|---|---|---|---|---|---|---|---|---|---|---|---|---|---|---|---|---|
| Sample | | 0.82 | 0.85 | 0.89 | 0.91 | 0.93 | 0.96 | 1.71 | 1.79 | 1.85 | 1.88 | 1.93 | 1.99 | Low | High | Low | High |
| Open | Peak | 1.4 | 1.1 | 0.3 | 0.7 | 0.9 | 0.2 | 3.2 | 1.6 | 0.9 | 1.0 | 0.9 | 1.1 | 0.73 | 1.50 | | |
| | Ave | -2.7 | -2.7 | -2.9 | -2.9 | -2.7 | -3.2 | -2.5 | -3.3 | -3.5 | -3.2 | -3.1 | -3.1 | -2.83 | -3.07 | 0.52 | 0.49 |
| Closed | Peak | 0.1 | 0.4 | 0.0 | -1.2 | -1.4 | -2.2 | 0.8 | 2.1 | 1.5 | 1.5 | 1.4 | 1.5 | -0.37 | 1.59 | | |
| | Ave | -3.6 | -3.3 | -3.8 | -5.1 | -5.7 | -6.9 | -2.5 | -2.9 | -3.6 | -3.4 | -3.4 | -3.3 | -4.33 | -3.09 | 0.37 | 0.49 |
| Open/Closed Delta | Peak | 1.4 | 0.7 | 0.3 | 1.9 | 2.3 | 2.4 | 2.4 | -0.5 | -0.6 | -0.1 | -0.6 | -0.4 | 1.1 | -0.1 | | |
| | Ave | 0.9 | 0.7 | 1.0 | 2.2 | 2.9 | 3.7 | 0.0 | -0.4 | 0.1 | 0.2 | 0.2 | 0.2 | 1.5 | 0.0 | | |
| Conventional | Peak | -1.9 | -1.1 | -1.6 | -2.0 | -2.6 | -5.0 | 1.9 | 2.0 | 1.0 | 1.2 | 1.2 | 0.0 | -1.36 | 1.74 | | |
| | Ave | -5.0 | -4.4 | -5.2 | -5.7 | -6.3 | -8.8 | -4.1 | -3.0 | -3.2 | -2.8 | -2.5 | -3.9 | -4.71 | -3.21 | 0.34 | 0.48 |

FIGURE 16

MULTI-BAND ANTENNA SYSTEMS INCLUDING A PLURALITY OF SEPARATE LOW-BAND FREQUENCY ANTENNAS, WIRELESS TERMINALS AND RADIOTELEPHONES INCORPORATING THE SAME

FIELD OF THE INVENTION

The invention generally relates to the field of communications, and more particularly, to antennas, wireless terminals, and radiotelephones incorporating the same.

BACKGROUND OF THE INVENTION

Wireless terminals may operate in multiple frequency bands in order to provide operations in multiple communications systems. For example, many cellular radiotelephones are now designed for dual-band or triple-band operation in GSM and CDMA modes at nominal frequencies of 850 MHz, 900 MHz, 1800 MHz and/or 1900 MHz. Digital Communications System (DCS) is a digital mobile telephone system that typically operates in a frequency band between 1710 MHz and 1880 MHz. The EGSM band used in much of the world typically operates between 880 MHz and 960 MHz.

Achieving effective performance in all of the above described frequency bands (i.e., "multi-band") may be difficult. For example, "clamshell" type radiotelephones (radiotelephones that open/close) may present particular design challenges in providing effective multi-band performance. In particular, in the case of a clamshell type radiotelephone, it is known that placing an internal antenna at the bottom of the radiotelephone may allow for relatively small shifts in the performance of the radiotelephone between the open and closed states. However, the bandwidth for such antennas (located at the bottom of these clamshell radiotelephones) may tend to be rather narrow. In contrast, when the antenna is placed near an intermediate portion of the clamshell (e.g., near the hinge) the bandwidth may be improved, but the performance in the open and closed states may vary dramatically. For example, in some cases where a bent monopole type antenna is included in the clamshell radiotelephone, the Voltage Standing Wave Ratio (VSWR) may be about 3:1 in the open state, whereas the VSWR may degrade to about 8:1 when the clamshell radiotelephone is closed. The NEC type 515 radiotelephone is one example of the type of clamshell radiotelephone with the antenna in the bottom of the phone as discussed above.

SUMMARY

Embodiments according to the invention can provide multi-band antenna systems including a plurality of separate low-band frequency antennas, wireless terminals, and radiotelephones including the same. Pursuant to these embodiments, a multi-band antenna system for a wireless terminal can include a first low-band antenna that configured to resonate in response to first electromagnetic radiation in a low-band frequency range in an active state and a second antenna, that is separate from the first low-band antenna, and is configured to resonate in response to second electromagnetic radiation in the low-band frequency range in the active state.

In some embodiments according to the invention, a multi-band antenna system can also include a common radiofrequency (RF) feed with first and second conductors that are electrically coupled to the first and second antennas respectively and that are configured to avoid resonating in response to electromagnetic radiation in the low-band frequency range.

In some embodiments according to the invention, the first and second conductors can be microstrip conductors or strip line conductors having a predetermined impedance of about 50 ohms, about 75 ohms, or about 100 ohms in the low-band frequency range. In some embodiments according to the invention, the first antenna can be a planar inverted F antenna including first and second antenna branches, wherein the first branch is configured to resonate in response to the first electromagnetic radiation and the second branch is configured to resonate in response to electromagnetic radiation in a high-band frequency range that is greater than the low-band frequency range.

In some embodiments according to the invention, the multi-band antenna system can also include a switch that is electrically coupled to the second antenna and that is configured to electrically isolate the second antenna from the first antenna in an open state. In some embodiments according to the invention, the first electromagnetic radiation can be first electromagnetic radiation in a first frequency range within the low-band frequency range and the second electromagnetic radiation can be second electromagnetic radiation in a second frequency range within the low-band frequency range that overlaps the first frequency range.

In some embodiments according to the invention, the first frequency range can be about 824 MHz to about 894 MHz and the second frequency range can be about 880 MHz to about 960 MHz. In some embodiments according to the invention, the first and second antennas are separated by at least about 20 mm. In some embodiments according to the invention, the multi-band antenna system can be included in a non-folding radiotelephone, wherein the first antenna is proximate to a top portion of the non-folding radiotelephone. In some embodiments according to the invention, the second antenna is proximate to a bottom portion of the non-folding radiotelephone that is distal from the top portion.

In some embodiments according to the invention, the second antenna extends substantially parallel to a bottom edge of the non-folding radiotelephone. In some embodiments according to the invention, the second antenna extends substantially parallel to a side edge of the non-folding radiotelephone toward the top portion.

In some embodiments according to the invention, the multi-band antenna system can be included in a folding radiotelephone, wherein the first antenna is proximate to an intermediate portion of the folding radiotelephone. In some embodiments according to the invention, the multi-band antenna system can also include a floating parasitic element proximate to the second antenna and ohmically isolated therefrom, wherein the floating parasitic element is configured to electromagnetically couple third electromagnetic radiation to the second antenna in a high-band frequency range that is greater than the low-band frequency range.

In some embodiments according to the invention, the second antenna comprises a monopole antenna, a bent monopole antenna, or a planar inverted F antenna. In some embodiments according to the invention, the second antenna can be a bent monopole antenna electrically coupled to a second conductor in series with a discrete element that may be used for matching, such as a capacitor or inductor.

BRIEF DESCRIPTION OF THE DRAWINGS

FIG. 13 is a table illustrating experimental and estimated performance of different multi-band wireless terminals according to some embodiments of the invention compared to a conventional wireless terminal.

FIG. 16 is a table that illustrates experimental performance data of different multi-band wireless terminals according to some embodiments of the invention compared to a conventional wireless terminal.

DESCRIPTION OF EMBODIMENTS ACCORDING TO THE INVENTION

Figure 1:
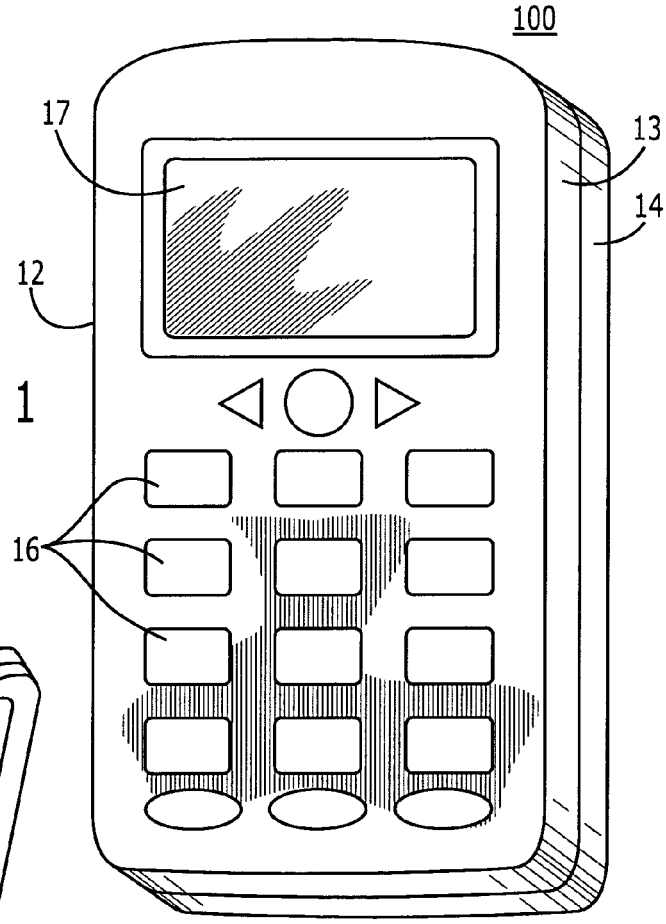
FIG. 1 is a schematic illustration of "stick" type multi-band wireless terminal according to some embodiments of the invention.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "coupled" to another element, it can be directly coupled to the other element or intervening elements may be present. In contrast, when an element is referred to as being "directly coupled" to another element, there are no intervening elements present. Like numbers refer to like elements throughout.

Spatially relative terms, such as "above", "below", "upper", "lower", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense expressly so defined herein. For example, as used herein, the term "avoiding radiating" will be interpreted to include substantially avoiding radiating to the extent that, for example, a conductor included in an RF feed to an antenna assembly according to the invention may radiate, but not to overly impact resonance of the antennas in the frequency bands in which the wireless terminal is intended to operate.

Embodiments of the invention are described herein with reference to schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, it will be understood that an antenna described as a "bent monopole" may be shown as including an idealized sharp angle but will, typically, have a rounded or curved angle rather than an idealized angle. Thus, the elements illustrated in the figures are schematic in nature and their shapes are not intended to illustrate the actual shape of a region of a device and are not intended to limit the scope of the invention.

As used herein, the term "wireless terminal" may include, but is not limited to, a cellular radiotelephone (or radiotelephone) with or without a multi-line display; a Personal Communications System (PCS) terminal that may combine a cellular radiotelephone with data processing, facsimile and data communications capabilities; a PDA that can include a wireless terminal, pager, Internet/intranet access, Web browser, organizer, calendar and/or a global positioning system (GPS) receiver; and a conventional laptop and/or palmtop receiver or other appliance that includes a wireless terminal transceiver. Wireless terminals may also be referred to as "pervasive computing" devices and may be mobile terminals.

As used herein, the term "multi-band" can include, for example, operations in any of the following bands: GSM, EGSM, DCS, PDC and/or PCS frequency bands. GSM operation can include transmission in a frequency range of about 824 MHz to about 849 MHz and reception in a frequency range of about 869 MHz to about 894 MHz. EGSM operation can include transmission in a frequency range of about 880 MHz to about 914 MHz and reception in a frequency range of about 925 MHz to about 960 MHz.

DCS operation can include transmission in a frequency range of about 1710 MHz to about 1785 MHz and reception in a frequency range of about 1805 MHz to about 1880 MHz. PDC operation can include transmission in a frequency range of about 893 MHz to about 953 MHz and reception in a frequency range of about 810 MHz to about 885 MHz. PCS operation can include transmission in a frequency range of about 1850 MHz to about 1910 MHz and reception in a frequency range of about 1930 MHz to about 1990 MHz. Other bands can also be used in embodiments according to the invention.

Figure 2:
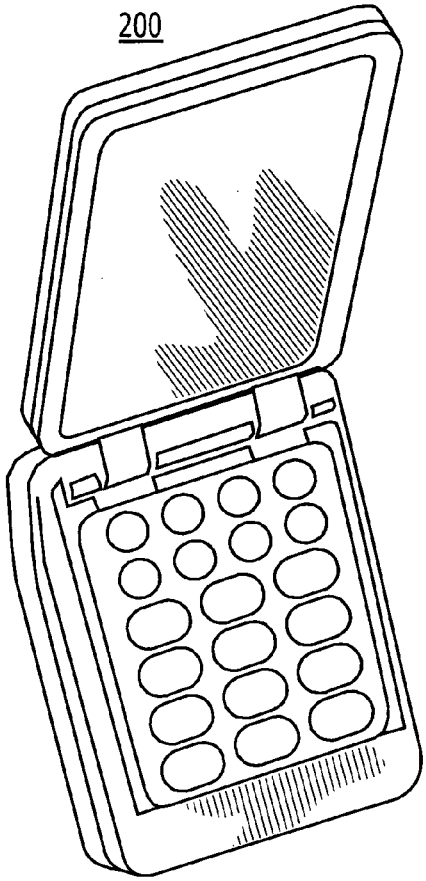
FIG. 2 is a schematic illustration of "clamshell" type multi-band wireless terminal according to some embodiments of the invention.

Multi-band antennas systems, including a plurality of separate low-band frequency antennas according to some embodiments of the invention, may be incorporated into multi-band wireless terminals 100 and 200 illustrated in FIGS. 1 and 2 respectively. The multi-band wireless terminals 100, 200 can each include a top housing portion 13 and a bottom housing portion 14 that are coupled together to form a housing 12 defining a cavity therein (not shown). The top and bottom housing portions 13, 14 house a keypad, which may include a plurality of keys 16, a display 17, and other electronic components (not shown) that enable the multi-band wireless terminals 100, 200 to transmit and receive communications signals to operate in multiple communications systems.

It will be understood that embodiments of multi-band antenna systems according to the invention can be included in the cavity defined by the housing 12. It will also be understood that, although embodiments of multi-band antennas according to the invention are described herein as included in the cavity, embodiments of multi-band antennas according to the invention may also be located outside the housing. In such embodiments, for example, a multi-band antenna system may be mounted on the bottom housing portion 13 and can be electromagnetically coupled to an another antenna in the cavity through the housing 12. Such external multi-band antennas systems according to some embodiments of the invention may be provided as add-on attachments after an initial sale (or other arrangement) of the wireless terminal to a subscriber.

It will be understood that the type of multi-band wireless terminal illustrated in FIG. 1 is sometimes referred to as a "stick" type radiotelephone, whereas the type of multi-band wireless terminal illustrated in FIG. 2 is sometimes referred to as a "clamshell" type radiotelephone. It will be further understood that, as used herein the term "stick" is used to refer generically to non-folding radiotelephones, whereas the term "clamshell" refers generically to folding radiotelephones.

Figure 3:
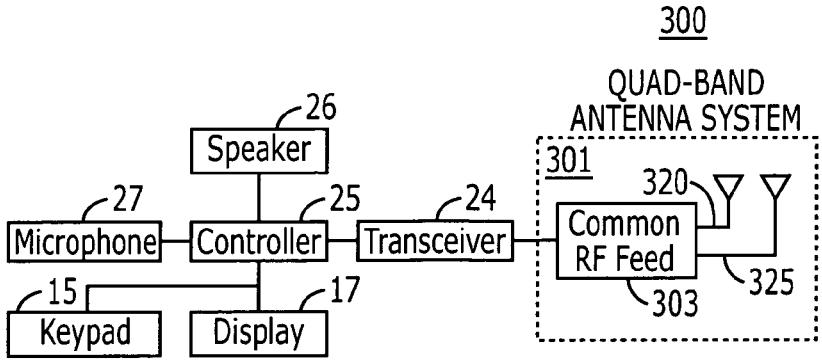
FIG. 3 is a block diagram that illustrates components included in multi-band wireless terminals according to some embodiments of the invention.

Referring now to FIG. 3, an arrangement of electronic components included in multi-band wireless terminals 300 according to some embodiments of the invention will be described in further detail. As illustrated, a multi-band antenna system 301 for receiving and/or transmitting Radio Frequency (RF) signals is electrically coupled to an RF transceiver 24 that is further electrically coupled to a controller 25, such as a microprocessor. The controller 25 is electrically coupled to a speaker 26 that is configured to transmit an audible signal to a user of a wireless terminal based on data provided, for example, by the controller 25. The controller 25 is also electrically coupled to a microphone 27 that is configured to receive audio input from a user and provide the input to the controller 25 and/or the transceiver 24 for transmission to a remote device. The controller 25 is electrically coupled to the keypad 15 and the display 17 to facilitate user input/output of data related to multi-band wireless terminal operations.

It will be understood by those skilled in the art that the multi-band antenna system 301 may be used for transmitting and/or receiving RF electromagnetic radiation to/from the multi-band wireless terminal 300 to support communications in multiple frequency bands. In particular, during transmission, the multi-band antenna system 301 resonates in response to signals received from a transmitter portion of the transceiver 24 and radiates corresponding RF electromagnetic radiation into free-space in the corresponding frequency band. During reception, the multi-band antenna system 301 resonates responsive to RF electromagnetic radiation received via free-space and provides a corresponding signal (in the corresponding frequency band) to a receiver portion of the transceiver 24.

The multi-band antenna system 301 shown in FIG. 3 includes a common RF feed 303 electrically coupled to a first low-band antenna 320 and a second low-band antenna 325. In particular, the first antenna 320 can provide a high-band antenna as well as the first low-band antenna for the multi-band wireless terminal 300. The first low-band antenna 320 can be configured to resonate responsive to electro magnetic radiation in a high-band frequency range and in a low-band frequency range in an active state, whereas the second low-band antenna 325 can be configured to resonate responsive to other electromagnetic radiation in the low-band frequency range in the active state. It will be understood that the term "active state" includes states of a wireless terminal according to the invention when receiving or transmitting. For example, the active state can be when the wireless terminal is transmitting or receiving. Accordingly, in some embodiments according to the invention, the first and second low band antennas can be configured radiate responsive to respective electromagnetic radiation in conjunction with one another when the wireless terminal is transmitting or receiving to provide operation in the low band.

For example, in some embodiments according to the invention, the first low-band antenna 320 can provide an antenna for high-band frequency operation in DCS and PCS systems and the first low-band antenna 320 for a frequency range within the low-band frequency (such as GSM and GSM for the multi-band wireless terminal when receiving or transmitting. The second low-band antenna 325 can resonate in response to other electromagnetic radiation in the low-band frequency range along with the first antenna 320 to provide increased bandwidth and increased Voltage Standing Wave Ratio (VSWR) performance in a low-band frequency range.

It will be further understood that the first and second low-band antennas 320 and 325 are separate from one another in that the common RF feed 303 can electrically isolate the first and second antennas from one another when operating in the different frequency bands of the multi-band wireless terminal. In particular, the common RF feed 303 can include first and second conductors electrically coupled to the first and second low-band antennas 320 and 325 respectively. In some embodiments according to the invention, the first and second conductors in the common RF feed 303 can be configured to substantially avoid radiating in response to electromagnetic radiation in each of the frequency bands in which the multi-band wireless terminal operates. For example, the first and second conductors can be microstrip or strip line conductors having an impedance of about 50-Ohms (Ω) in the low-band frequency range.

In some embodiments according to the invention, the high-band frequency range can include the DCS and PCS systems described above. It will further be understood that the low-band frequency range can include the EGSM and GSM systems described above. Accordingly, the first low-band antenna 320 can be configured to resonate in response to electromagnetic radiation in the high-band frequency range (i.e. DCS/PCS) and resonate in response to electromagnetic radiation in low-band frequency range (i.e. GSM/EGSM).

Figure 4:
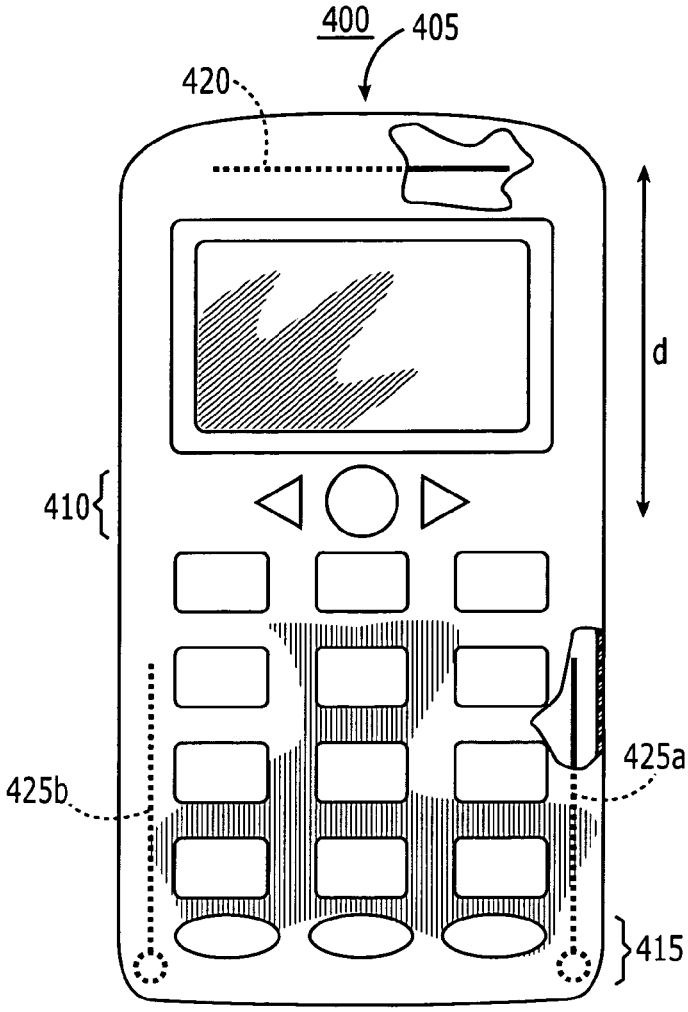
FIGS. 4 and 5 are schematic illustrations of stick type multi-band wireless terminals having first and second low-band antennas according to some embodiments of the invention.

FIG. 4 is a schematic diagram illustrating a multi-band stick type wireless terminal 400 including first and second separate low-band antennas according to some embodiments of the invention (sometimes referred to as non-folding radio telephones or wireless terminals). In particular, the multi-band wireless terminal 400 includes a top portion 405 and a bottom portion 415 that is distal from the top portion 405. The multi-band wireless terminal 400 also includes an intermediate portion 410 located between the top portion 405 and the bottom portion 415. It will be understood that as used herein the terms top and bottom refer to portions of the multi-band wireless terminal as they would be oriented during typical operation by a user. For example, the top portion 405 would normally be positioned pointing upward when the user is listening to the speaker in the multi-band wireless terminal 400, whereas the bottom portion 415 would point downward when in typical use. It will be understood however that the multi-band wireless terminal 400 may be placed in other orientations while in use such as in speaker phone mode or when the headset is in use.

As shown in FIG. 4, a first low-band antenna 420 is located proximate to the top portion 405 of the multi-band wireless terminal 400. The first low-band antenna 420 can be configured to resonate responsive to electromagnetic radiation in both the high-band and low-band frequency ranges. A second low-band antenna 425A, spaced-apart from the first low-band antenna 420 by a distance "d", is located proximate to the bottom portion 415 of the multi-band wireless terminal 400 and extends along an edge of the multi-band wireless terminal 400 from the bottom portion 415 toward the intermediate portion 410. In particular, the first and second low-band antennas 420 and 425A can be spaced apart so that no respective portions thereof are closer than 20 mm to one another to allow a reduction in parasitic coupling between the first and second low-band antennas 420 and 425A.

Still referring to FIG. 4, in some embodiments according to the invention, the second low-band antenna (referred to here as 425B) can alternatively be located along an opposite edge of the multi-band wireless terminal 400 such that the minimum separation of 20 mm is maintained between the first and second low-band antennas 405 and 425B. In still, other embodiments according to the invention, both second low-band antennas 425A and 425B are included in the multi-band wireless terminal 400. It will be understood that the first low-band antenna 420 can be a planar inverted F antenna (PIFA) including two antenna branches wherein one of the antenna branches resonates in the high-band frequency range and the other branch resonates in the low-band frequency range.

To facilitate effective performance during transmission and reception, the impedance of the multi-band antenna system 301 can be "matched" to an impedance of the transceiver 24 to maximize power transfer between the multi-band antenna system 300 and the transceiver 24. It will be understood that, as used herein, the term "matched" includes configurations where the impedances are substantially electrically tuned to compensate for undesired antenna impedance components to provide a particular impedance value, such as 50-Ohms (Ω), at a common RF feed of the multi-band antenna system 300.

Figure 6:
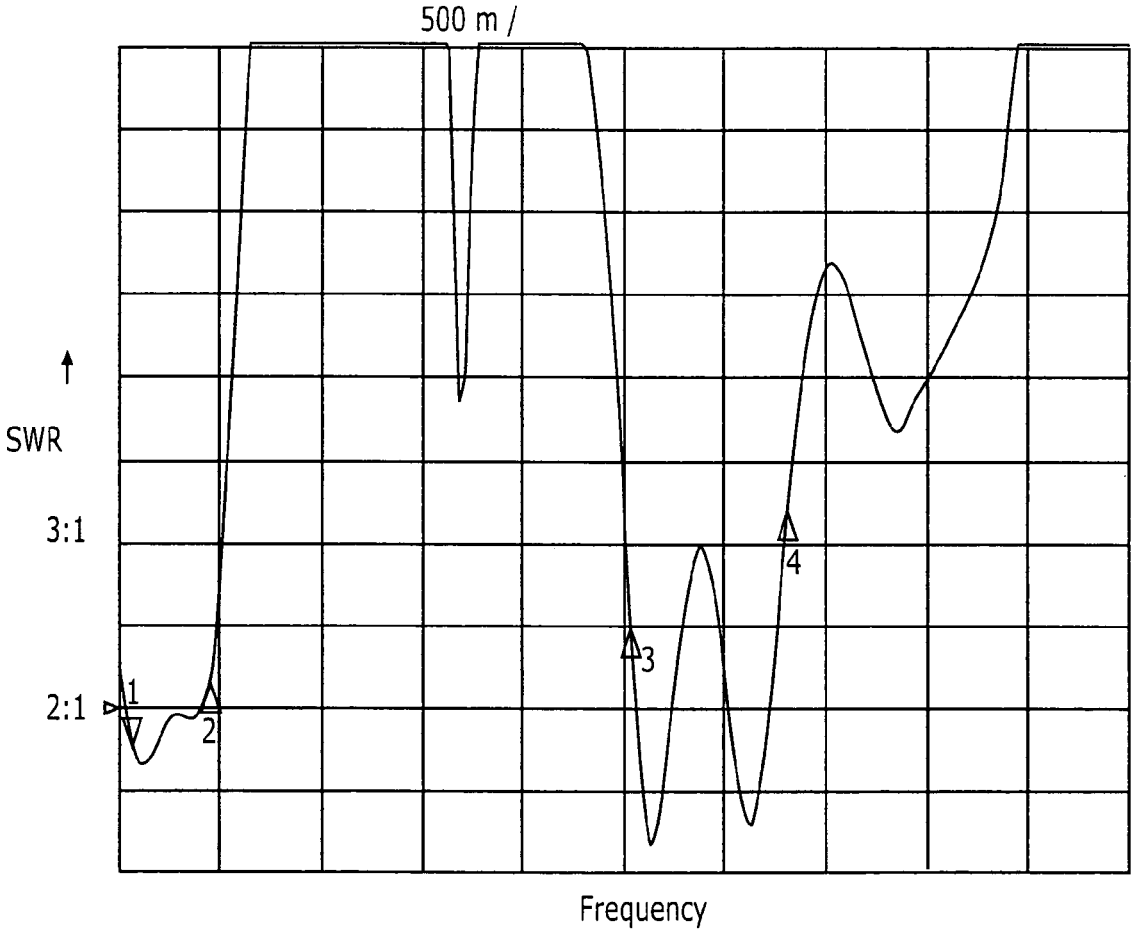
FIGS. 6 and 7 are VSWR graphs illustrating performance of exemplary multi-band wireless terminals according to some embodiments of the invention.

FIG. 6 is a VSWR graph that illustrates exemplary performance of the multi-band wireless terminal 400 shown in FIG. 4. In particular, the low-band frequency performance, between markers 1 and 2, is about 2:1 VSWR, whereas the high-band frequency performance, between markers 3 and 4, is about 3:1 VSWR. It will be understood that the inclusion of the second low-band antenna 425A/425B in the multi-band wireless terminal 400 can improve the bandwidth in the low-band frequency range as shown in FIG. 6. Although the introduction of the inclusion of the second low-band antenna 425A/425B in the multi-band wireless terminal 400 can adversely impact performance of the multi-band wireless terminal in the high-band frequency range, the negative impact may be out weighed by the overall improvement in the bandwidth and VSWR in the low-band frequency range, thereby enabling adequate performance in all four frequency bands.

According to FIG. 6, first and second components of the signal can be combined to provide the VSWR for the multi-band antenna system 300 in the low-band frequency of about 2:1. In particular, one of the components shown in the low-band frequency range in FIG. 6 can be attributed to the resonance of the first low-band antenna in the low-band frequency range, whereas the other component shown in the low-band frequency range can be attributed to the resonance of the second low-band antenna in the low-band frequency range. As shown, the resonance components may overlap to provide increased bandwidth in the low-band frequency range. Accordingly, the first and second low band antennas can be configured radiate responsive to respective electromagnetic radiation in conjunction with one another when the wireless terminal is transmitting or receiving to provide operation in the low band.

A VSWR associated with the multi-band antenna system relates to the impedance match of the multi-band antenna system with the common RF feed or transmission line of the wireless terminal. To radiate electromagnetic RF radiation with a minimum loss, or to provide received RF radiation to the transceiver in the wireless terminal with minimum loss, the impedance of the multi-band antenna system 300 may be matched to the impedance of the transmission line or common RF feed via which electromagnetic RF radiation is provided to/from the multi-band antenna system 300.

Figure 5:
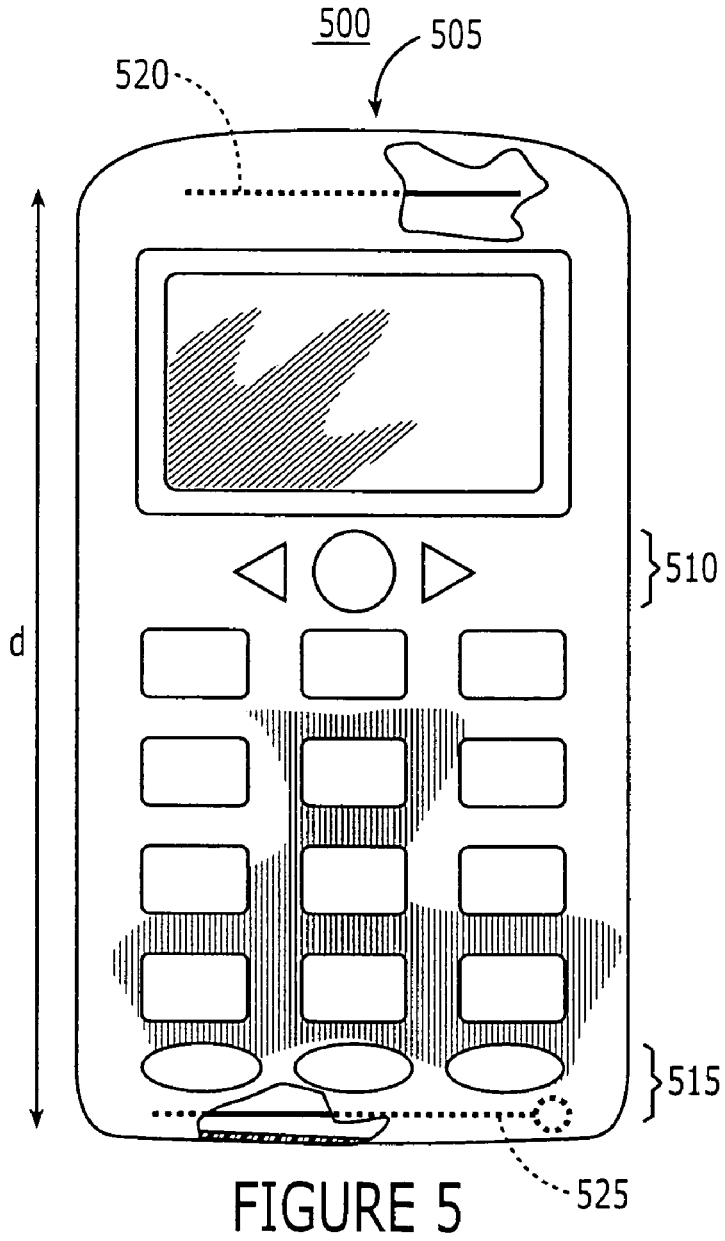

FIG. 5 is a schematic diagram illustrating multi-band wireless terminals according to embodiments of the invention. In particular, a multi-band wireless terminal 500 includes the first antenna 520 and a top portion 505 thereof. As described above, the first antenna 520 can be configured to resonate in the high band frequency range as well as in a portion of the low-band frequency range. In particular, the first antenna 520 can be a PIFA antenna wherein one antenna branch of the first antenna 520 resonates in the high-band frequency range whereas the other antenna branch resonates in the low-band frequency range. The multi-band terminal 500 also includes a second antenna 525 located proximate to a bottom portion 515 at the multi-band terminal 500. As described above, the distance "d" separating the first antenna 520 from the second antenna 525 should be greater than 20 mm.

As described above in reference to FIG. 4, the first antenna 520 and the second antenna 525 are configured to resonate an overlapping portion of the low-band frequency range which may improve the bandwidth in VSWR performance of the multi-band wireless terminal in the low-band frequency range. As shown in FIG. 5, the second antenna 525 extends along an edge at the portion 515 of the multi-band wireless terminal 500.

Figure 7:
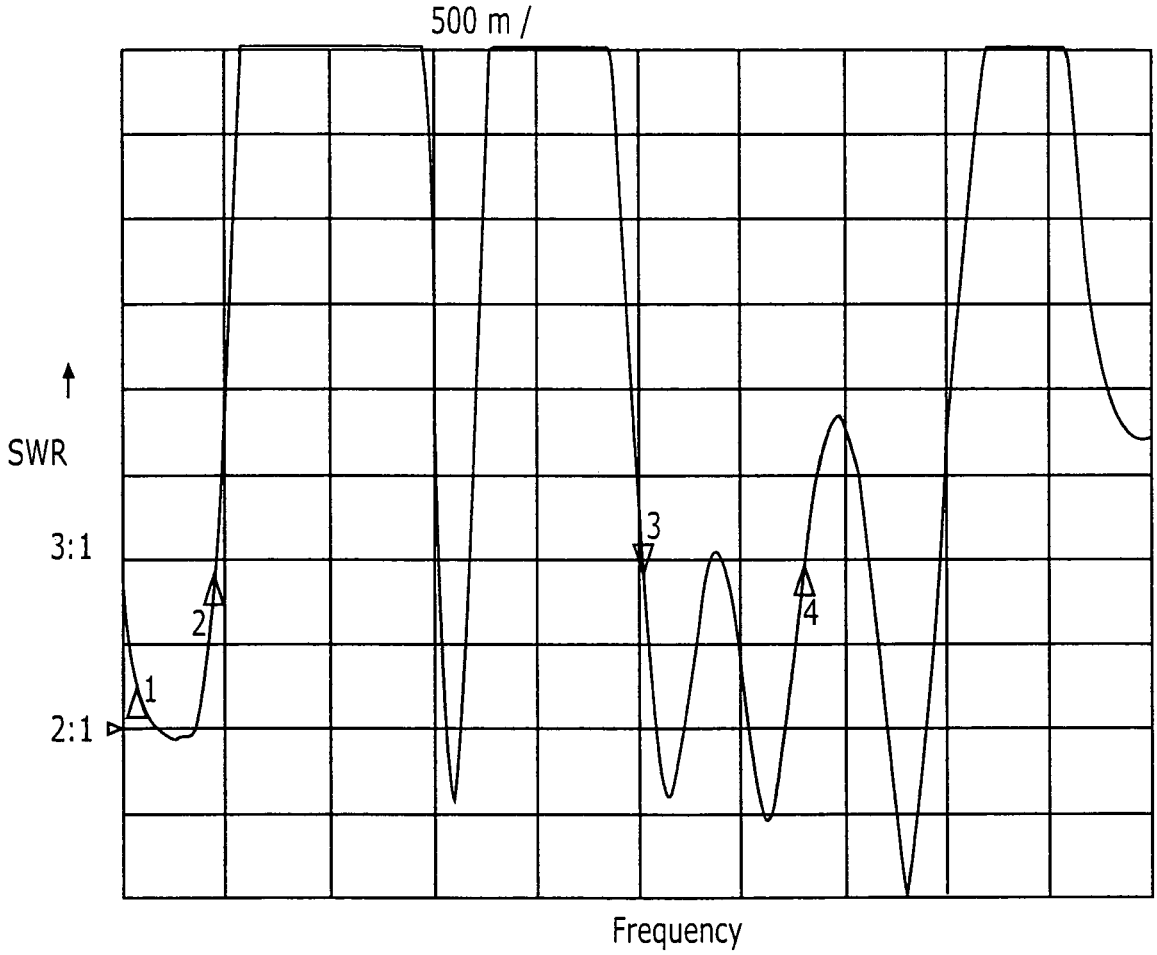

FIG. 7 is a VSWR graph that illustrates exemplary performance of the multi-band wireless terminal 500 shown in FIG. 5. According to FIG. 7, the bandwidth in the low-band frequency range is shown between markers 1 and 2, whereas the bandwidth in the high-band frequency range is shown between markers 3 and 4. The VSWR performance in a low-band frequency range is between 2:1 and 3:1 and VSWR performance in a high-band frequency range is about 3:1. The inclusion of the second low-band antenna 525 in the multi-band wireless terminal 500 can improve the bandwidth and VSWR performance in the low-band frequency range. Accordingly, in some embodiments according to the invention, the first and second low band antennas can be configured radiate responsive to respective electromagnetic radiation in conjunction with one another when the wireless terminal is transmitting or receiving to provide operation in the low band.

Although the inclusion of the second low-band antenna 525 in the multi-band wireless terminal 500 can adversely effect the VSWR performance and bandwidth of the multi-band wireless terminal 500 in the high-band frequency range, it will be understood that the adverse effects in high-band frequency range may be outweighed by the performance improvement in the low-band frequency range.

Figure 8:
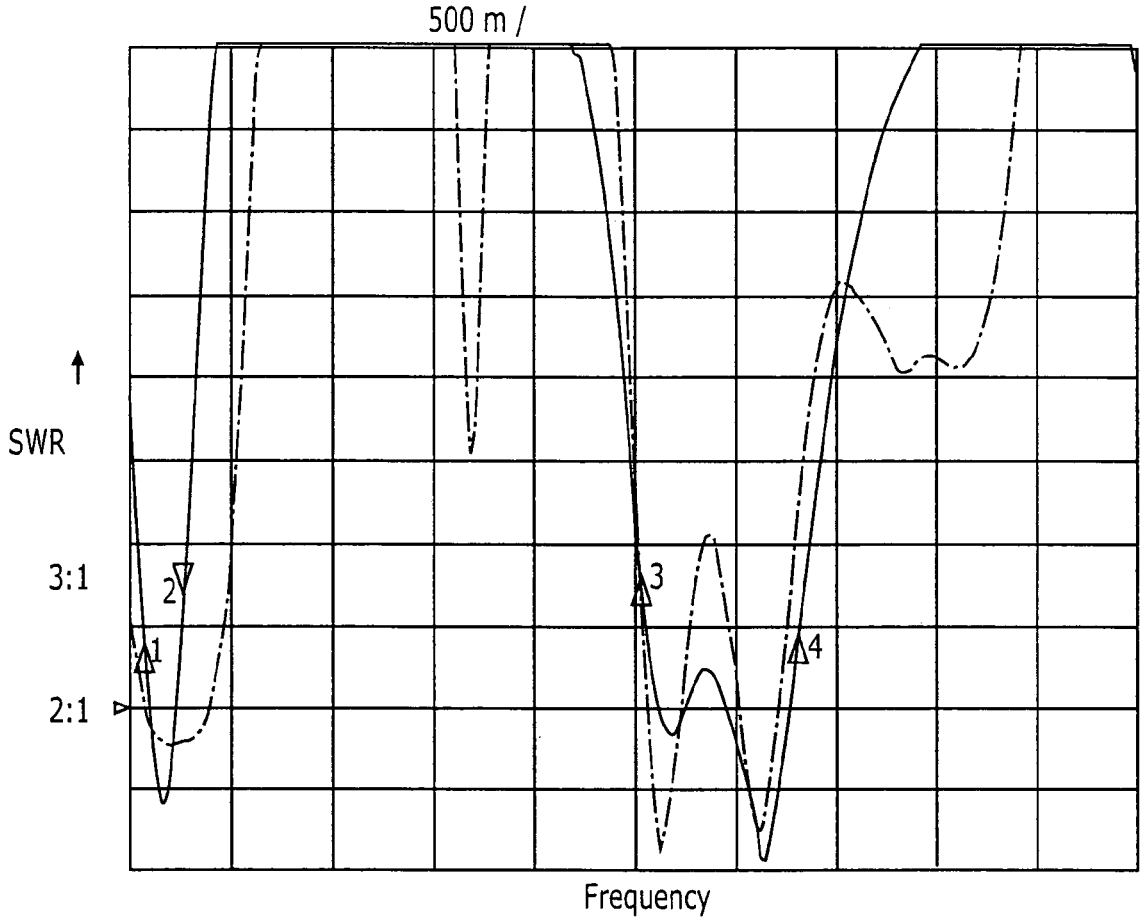
FIG. 8 is a VSWR graph that illustrates performance of exemplary multi-band wireless terminals according to some embodiments of the invention compared to a conventional wireless terminal.

FIG. 8 is a VSWR graph illustrating a comparison between exemplary performance of a multi-band wireless terminal according to some embodiments of the invention and a conventional wireless terminal. In particular, the performance of the conventional terminal is shown by the solid line, whereas the exemplary performance of the multi-band wireless terminal according to some embodiments in the invention is illustrated by the dashed line. As shown in FIG. 8, the bandwidth in the low-band frequency range of the multi-band wireless terminal according to some embodiments of the invention exceeds the bandwidth associated with the conventional wireless terminal.

As shown in FIG. 8, the VSWR performance of the multi-band wireless terminal according to the embodiments of the invention may also exceed the performance of the conventional wireless terminal. Furthermore, the bandwidth of the multi-band wireless terminal according to some embodiments of the invention can be greater than the bandwidth associated with conventional wireless terminals. The high-band VSWR performance between markers 3 and 4 is about equal for both the multi-band wireless terminal according to some embodiments of the invention and the conventional wireless terminal.

Figure 9:
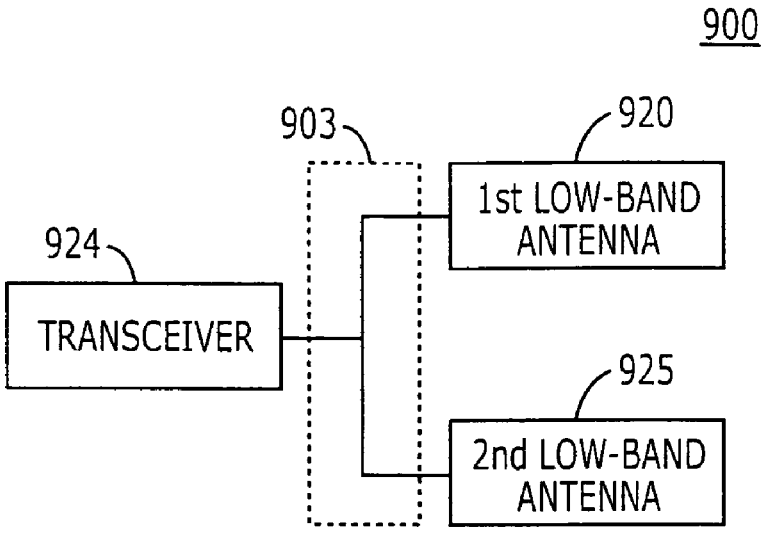
FIGS. 9 and 10 are block diagrams of transceivers and multi-band antenna systems included in multi-band wireless terminals according to some embodiments of the invention.

FIG. 9 is a block diagram that illustrates multi-band antenna systems 900 according to some embodiments of the invention. In particular, a transceiver 924 is electrically coupled to first and second low-band antennas 920 and 925 by a common RF feed 903. The common RF feed 903 includes first and second conductors that are configured to substantially avoid radiating in low-band frequency range. The first and second conductors can be configured to provide about a 50-Ohm (Ω) impedance to signals in the low-band frequency range and may be constructed as micro-strip conductors or strip-line conductors.

As described above, the first low-band antenna 920 is configured to radiate responsive to electromagnetic radiation in the low-band frequency range. The second low-band antenna 925 is separate from the first low-band antenna 920 and is also configured to radiate responsive to electromagnetic radiation in the low-band frequency range. The common RF feed 903, therefore, can electrically isolate the first low-band antenna 920 from the separate second low-band antenna 925 to avoid resonating responsive to electromagnetic radiation in the low-band frequency range. Moreover, the first and second low-band antennas 920 and 925 are separated from one another within the multi-band wireless terminal by spacing of at least about 20 mm.

Figure 10:
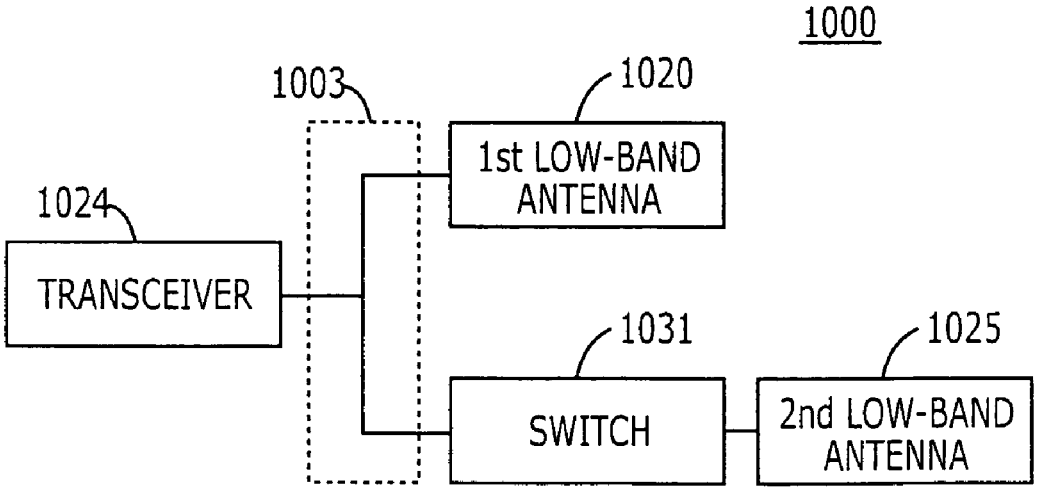

FIG. 10 is a block diagram that illustrates multi-band antenna systems 1000 according to some embodiments in the invention. In particular, a transceiver 1024 is electrically coupled to a first low-band antenna 1020 and a switch 1021 via a common RF feed 1003. As described above, the common RF feed 1003 can include first and second conductors configured to substantially avoid resonating responsive to electromagnetic radiation in the low-band frequency range.

The switch 1031 is electrically coupled to a second low-band antenna 1025. The switch 1031 is configured to operate in one of two states: an open state and a close state. In the closed state the switch 1031 electrically couples the transceiver 1024 to the second low-band antenna 1025 via the common RF feed 1003. In contrast, when the switch 1031 is in the open state, the second low-band antenna 1025 is ohmically isolated from the common RF feed 1003 and the transceiver 1024. It will be understood that the switch 1031 can be any type of electronic component suitable for use in the low-band frequency range, such as a high frequency transistor, GA switch, MEMS switch, pin diode, or similar switching mechanism.

Therefore, the multi-band antenna system 1000 according to some embodiments of the invention shown in FIG. 10 can be operated to switch the second low-band antenna 1025 in/out of the multi-band antenna system 1000. When the second low-band antenna 1025 is switched out of the multi-band antenna system (by opening the switch 1031), the first low-band antenna 1020 may offer adequate performance in both the high-band and low-band frequency ranges. When the switch 1031 is closed to include the second low-band antenna 1025 in the multi-band antenna system 1000, the performance in the low-band frequency range may be improved, whereas the performance in the high-band frequency range may remain adequate. Accordingly, the configuration of the multi-band antenna system 1000 according to some embodiments in the invention can be adjusted based on the frequency bands in which the wireless terminal is to operate.

As used herein, the term "ohmically" refers to configurations where an impedance between two elements is substantially given by the relationship of Impedance=V/I, where V is a voltage across the two elements and I is the current therebetween, at substantially all frequencies (i.e., the impedance between ohmically coupled elements is substantially the same at all frequencies. Therefore, the phrase "ohmically isolated" refers to configurations where the impedance between two elements is substantially infinite at relatively low frequency (such as DC). However, it will be understood that although the two elements may be ohmically isolated, the impedance between the two elements can be a function of frequency where, for example, the elements are capacitively coupled to one another. For example, two elements directly coupled together by a metal conductor are not ohmically isolated from one another. In contrast, two elements that are electrically coupled to one another only by a capacitive effect are ohmically isolated from one another and electromagnetically coupled to one another.

Figure 11:
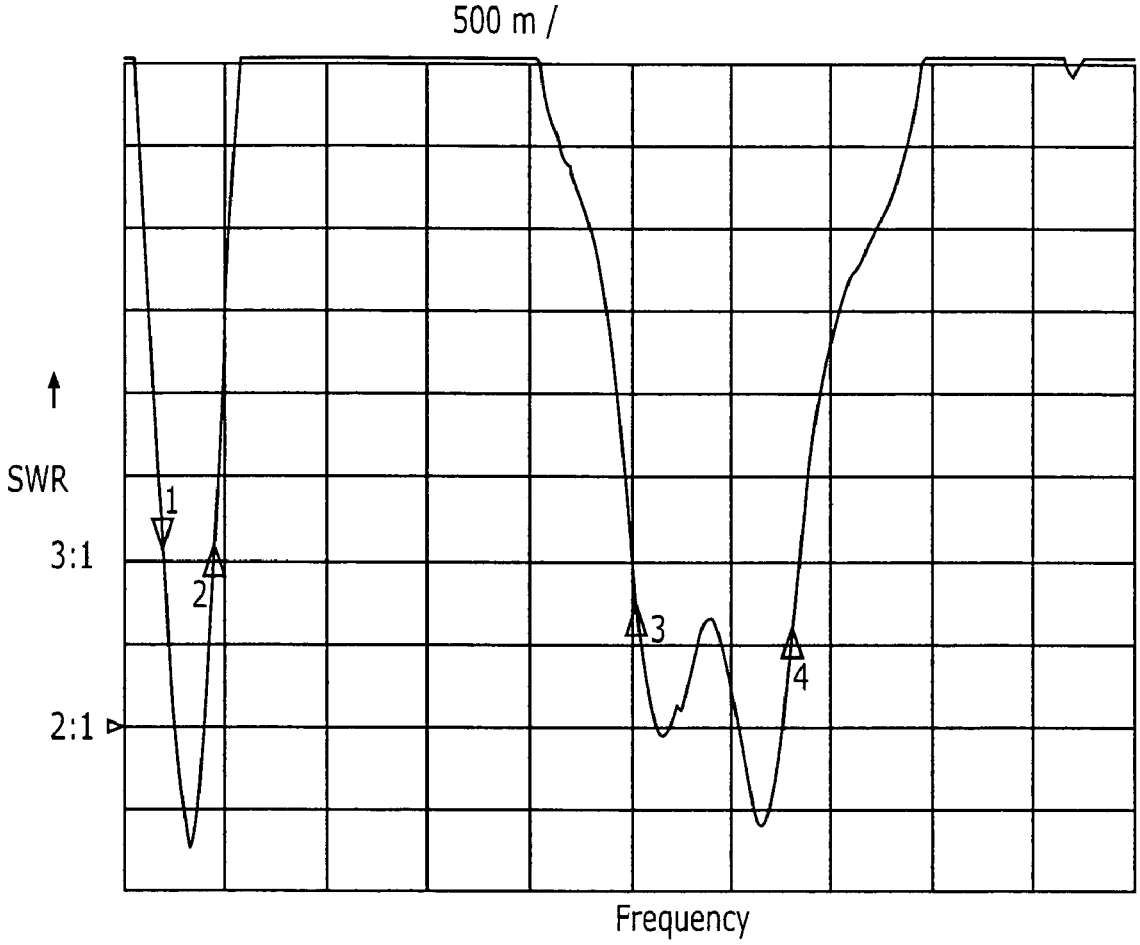
FIGS. 11 and 12 are VSWR graphs illustrating exemplary performance of multi-band wireless terminals according to some embodiments of the invention.
Figure 12:
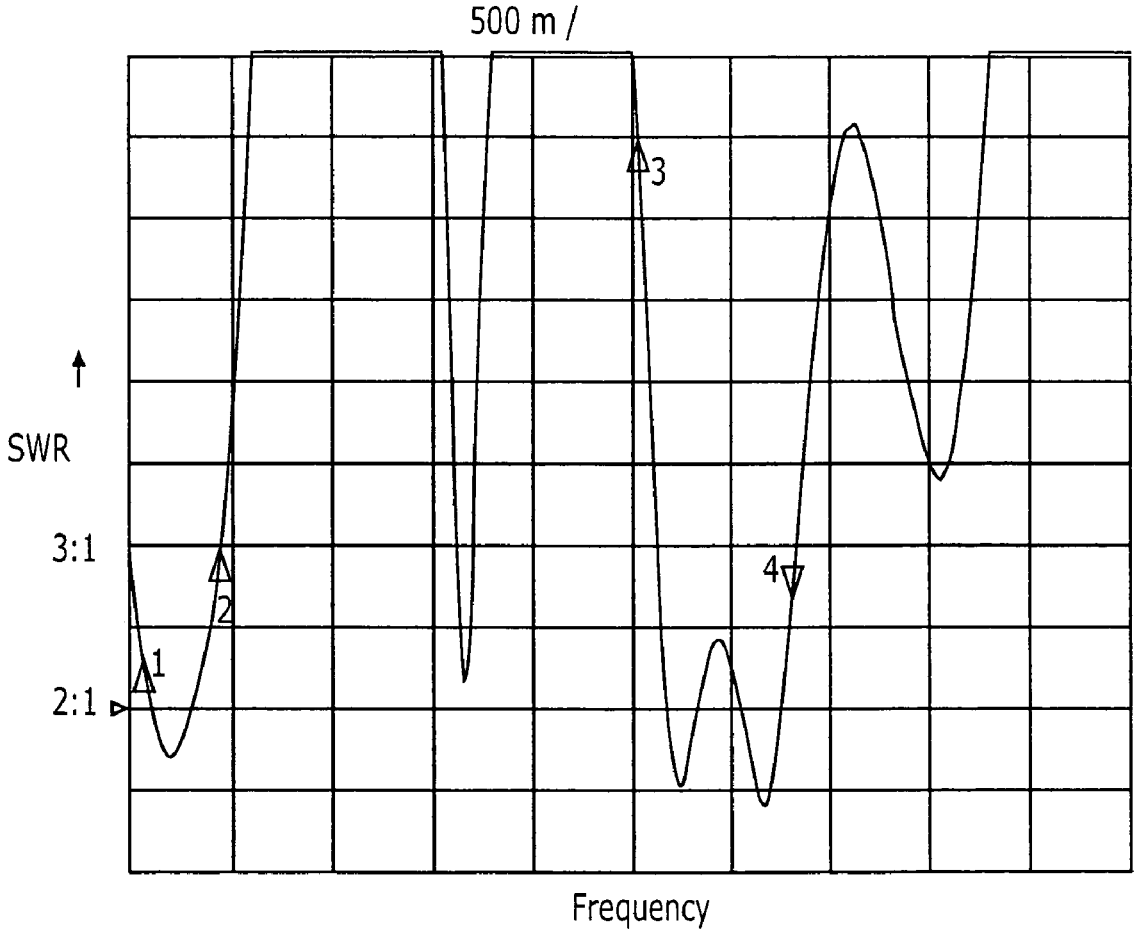

FIGS. 11 and 12 are VSWR graphs that illustrate exemplary performance of multi-band wireless terminals having the second low-band antenna switched out and in of the antenna system according to some embodiments of the invention respectively. In particular, FIG. 11 illustrates that the high-band frequency VSWR performance is between 3:4 and 2:1 whereas the bandwidth in the low-band frequency range tends to be somewhat narrow and the VSWR performance is about 3:1. In comparison, as shown in FIG. 12, when the switch 1031 is closed to include the second low-band antenna 1025 in the multi-band antenna system 1000, the bandwidth and the low-band frequency range is improved and the VSWR performance is also increased to about 2:1. Furthermore, FIG. 12 also shows that VSWR performance in the high-band frequency range may be reduced by the inclusion of the second low-band antenna 1025.

FIG. 13 is a table that illustrates exemplary performance of multi-band wireless terminals according to some embodiments of the invention in comparison to conventional wireless terminals. In particular, the table in FIG. 13 shows gain measurements in the low-band frequency range and in the high-band frequency range. The measurements taken extended over the range from about 824 MHz to about 1990 MHz. Furthermore, the embodiments described above where the second low-band antenna was included proximate to the side of the multi-band wireless terminal and at the bottom of the multi-band wireless terminal, and the embodiment where the second low-band antenna was switched in/out are shown in FIG. 13. In particular, the data in FIG. 13 shows that the performance of the embodiment where the second low-band antenna was located near the bottom of the multi-band wireless terminal has overall improved performance in the low-band frequency range and in the high-band frequency range, in comparison to the performance of the conventional wireless terminal.

Figure 14A:
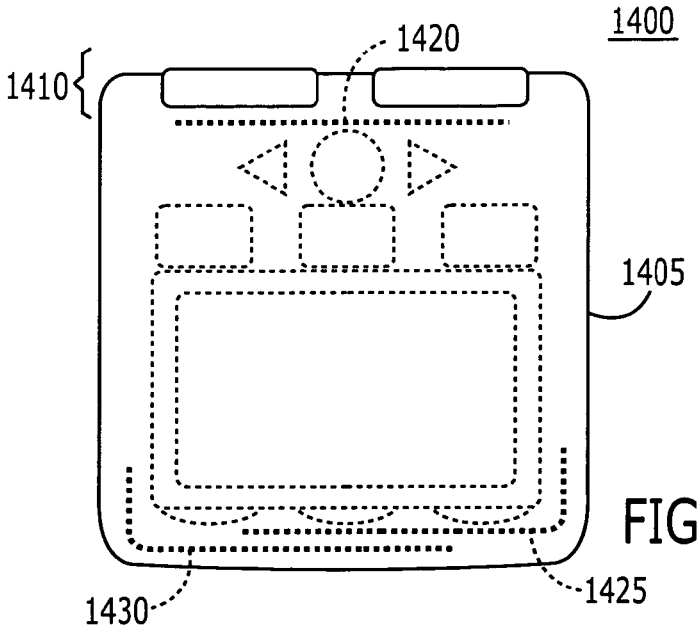
FIGS. 14A and 14B are schematic illustrations of clamshell type multi-band wireless terminal according to some embodiments of the invention in the closed and open states respectively.
Figure 14B:
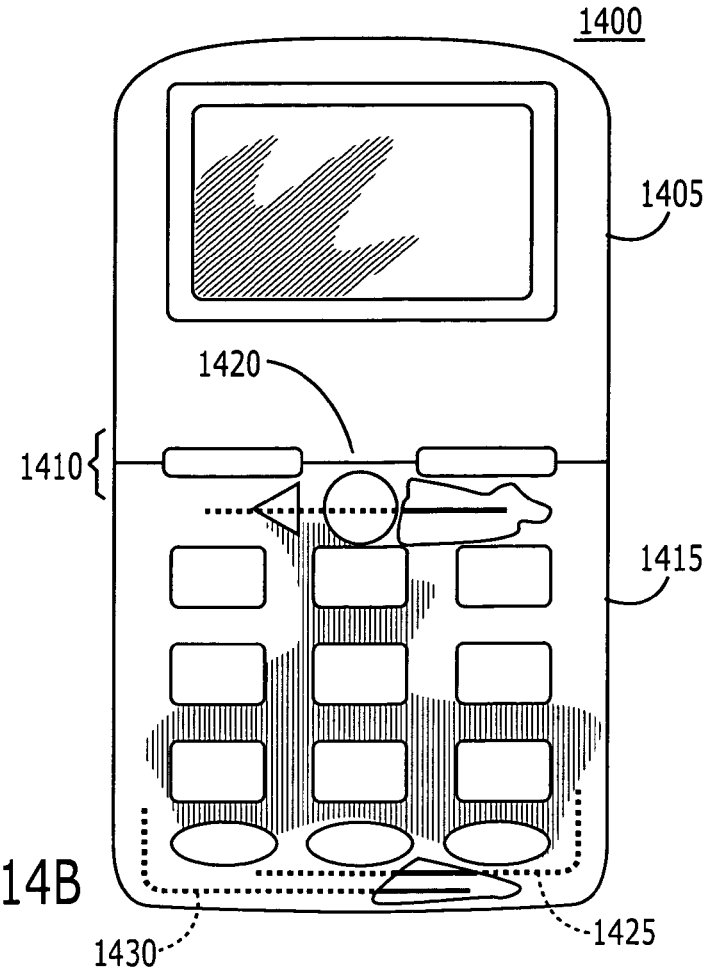

FIGS. 14A and 14B are schematic diagrams of clamshell type wireless terminals according to some embodiments of the invention (sometimes referred to as folding radio telephones or wireless terminals). In particular, FIG. 14A illustrates the clamshell type wireless terminal 1400 in the closed position. In the closed position, a top portion 1405 is rotated about a hinge located proximate to an intermediate portion 1410, to meet a bottom portion 1415 of the multi-band wireless terminal. FIG. 14B illustrates the open position of the multi-band clamshell type wireless terminal 1400.

According to FIGS. 14A and 14B, a first low-band antenna 1420 is located approximate to the intermediate portion 1410 of the multi-band clamshell type wireless terminal 1400. A second low-band antenna 1425 is located proximate to the bottom portion 1415, which is distal from the first low-band antenna 1420 and separate therefrom. The multi-band clamshell type wireless terminal 1400 can also include a parasitic element 1430 that is proximate to the second low-band antenna 1425 and is ohmically isolated therefrom, but can be capacitively coupled thereto. In this example, the parasitic element 1430 is configured to resonate in response to electromagnetic radiation in the high-band frequency range whereas the first and second low-band antennas 1420 and 1425 are configured to resonate responsive to electromagnetic radiation in the low-band frequency range.

Figure 15:
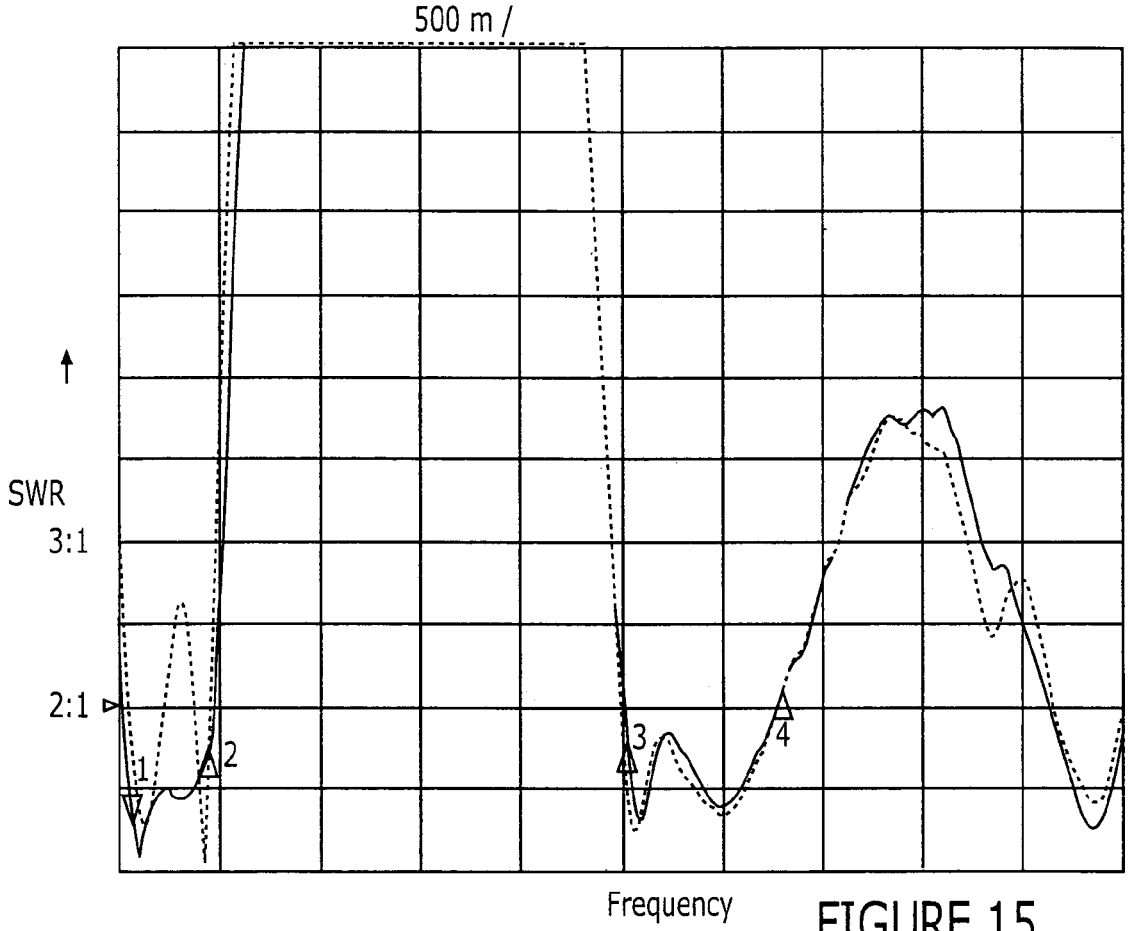
FIG. 15 is a VSWR graph that illustrates exemplary performance of wireless multi-band terminals according to some embodiments of the invention in open and closed states as shown in FIGS. 14A and 14B.

It will be understood that the performance of the multi-band clamshell type wireless terminal 1400 can vary in the open and closed states. In particular, FIG. 15 is a VSWR graph that illustrates the variation in performance between the open and closed states of the multi-band clamshell type wireless terminal 1400. According to FIG. 15, in the closed state, the VSWR performance is about 3:1 in the low-band frequency range between markers 1 and 2. In the open state, the VSWR performance in the low-band frequency range is improved to about 2:1. In contrast, the VSWR performance in the high-band frequency range is about the same in both the open and closed states at about 2:1.

FIG. 16 is a table that illustrates exemplary data comparing multi-band type clamshell wireless terminals according to some embodiments of the invention to conventional wireless terminals. As shown in FIG. 16, the gain in the high-band frequency range is about the same in the opened and closed states. In contrast, the gain in the low-band frequency range decreases by about 1 dB in theGSM frequency range whereas the gain decreases by about 3.7 dB in the EGSM frequency range between the opened and closed states.

The first and second components of the signal can be combined to provide a Voltage Standing Wave Ratio (VSWR or SWR) for the multi-band antenna 300 in the first frequency band in a range between about 2.5 and about 1.0. A VSWR associated with the multi-band antenna 22 relates to the impedance match of the multi-band antenna 22 feed with a feed line or transmission line of the wireless terminal. To radiate electromagnetic RF radiation with a minimum loss, or to provide received RF radiation to the transceiver in the wireless terminal with minimum loss, the impedance of the multi-band antenna 300 is matched to the impedance of the transmission line or feed point via which electromagnetic RF radiation is provided to/from the multi-band antenna 300.

It will be understood by those of skill in the art that the antennas may be formed on a dielectric substrate of FR4 or polyimide, by etching a metal layer or layers in a pattern on the dielectric substrate. The antenna can be formed of a conductive material such as copper. For example, the antenna may be formed from a copper sheet. Alternatively, the antenna may be formed from a copper layer on the dielectric substrate. It will be understood that antennas according to embodiments of the invention may be formed from other conductive materials and are not limited to copper.

Antennas according to embodiments of the invention may have various shapes, configurations, and/or sizes and are not limited to those illustrated. For example, the invention may be implemented with any micro-strip antenna. Moreover, embodiments of the invention are not limited to planar inverted-F antennas having two branches or mono-pole or bent monopole antennas.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. A multi-band antenna system for a wireless terminal comprising:

a first low-band antenna configured to resonate in response to first electromagnetic radiation in a low-band frequency range during an active state;

a second low-band antenna, separate from the first low-band antenna, configured to resonate in response to second electromagnetic radiation in the low-band frequency range during the active state; and a common radiofrequency (RF) feed including first and second conductors electrically coupled to the first and second antennas respectively and configured to avoid resonating in response to electromagnetic radiation in the low-band frequency range.

2. A multi-band antenna system according to claim 1 wherein the first and second conductors comprising microstrip conductors or strip line conductors or coaxial cable, having a predetermined impedance.

3. A multi-band antenna system according to claim 2 wherein the predetermined impedance is about 50 ohms, about 75 ohms, or about 100 ohms in the frequencies of operation.

4. A multi-band antenna system according to claim 1 wherein the first antenna comprises a planar inverted F antenna including at least first and second antenna branches, wherein the first branch is configured to resonate in response to the first electromagnetic radiation and the second branch is configured to resonate in response to electromagnetic radiation in a high-band frequency range that is greater than the low-band frequency range.

5. A multi-band antenna system according to claim 4 further comprising:

a switch electrically coupled to the second antenna and configured to electrically isolate the second antenna from the first antenna in an open state.

6. A multi-band antenna system according to claim 1:

wherein the first electromagnetic radiation comprises first electromagnetic radiation in a first frequency range within the low-band frequency range; and wherein the second electromagnetic radiation comprises second electromagnetic radiation in a second frequency range within the low-band frequency range that overlaps the first frequency range.

7. A multi-band antenna system according to claim 6:

wherein the first frequency range comprises about 810 MHz to about 885 MHz; and wherein the second frequency range comprises about 880 MHz to about 960 MHz.

8. A multi-band antenna system according to claim 6:

wherein the first frequency range comprises about 824 MHz to about 894 MHz; and wherein the second frequency range comprises about 893 MHz to about 958 MHz.

9. A multi-band antenna system according to claim 1 wherein the first and second antennas are separated by at least about 20 mm.

10. A multi-band antenna system according to claim 1 included in a non-folding radiotelephone, wherein the first antenna is proximate to a top portion of the non-folding radiotelephone.

11. A multi-band antenna system according to claim 10 wherein the second antenna is proximate to a bottom portion of the non-folding radiotelephone that is distal from the top portion.

12. A multi-band antenna system according to claim 11 wherein the second antenna extends substantially parallel to a bottom edge of the non-folding radiotelephone.

13. A multi-band antenna system according to claim 11 wherein the second antenna extends substantially parallel to a side edge of the non-folding radiotelephone toward the top portion.

14. A multi-band antenna system according to claim 11 further comprising:

a floating parasitic element proximate to the second antenna and obmically isolated therefrom, wherein the floating parasitic element is configured to electromagnetically couple third electromagnetic radiation to the second antenna in a high-band frequency range that is greater than the low-band frequency range.

15. A multi-band antenna system according to claim 1 included in a folding radiotelephone, wherein the first antenna is proximate to an intermediate portion of the folding radiotelephone.

16. A multi-band antenna system according to claim 1 wherein the second antenna comprises a monopole antenna, a bent monopole antenna, or a planar inverted F antenna.

17. A multi-band wireless terminal comprising:

a housing that defines a cavity therein;

a transceiver, in the cavity, that receives multi-band wireless communications signals and that transmits multi-band wireless communications signals;

a common radiofrequency (RF) feed in the cavity including first and second conductors electrically coupled to the transceiver and electrically coupled to the first and second antennas respectively and configured to avoid resonating in response to electromagnetic radiation in the frequency bands of operation of the antennas; and a multi-band antenna system in the cavity comprising a first low-band antenna electrically coupled to the first conductor and configured to resonate in response to first electromagnetic radiation in the low-band frequency range in an active state; and a second low-band antenna, electrically coupled to the second conductor and separate from the first antenna, configured to resonate in response to second electromagnetic radiation in the low-band frequency range in the active state.

18. A multi-band wireless terminal according to claim 17 wherein the first and second conductors comprise microstrip conductors or strip line conductors having a predetermined impedance in the low-band frequency range.

19. A multi-band wireless terminal according to claim 18 wherein the predetermined impedance is about 50 ohms, about 75 ohms, or about 100 ohms in the frequencies of operation.

20. A multi-band wireless terminal according to claim 17 wherein the first antenna comprises a planar inverted F antenna including first and second antenna branches, wherein the first branch is configured to resonate in response to the first electromagnetic radiation and the second branch is configured to resonate in response to electromagnetic radiation in a high-band frequency range that is greater than the low-band frequency range.

21. A multi-band wireless terminal according to claim 20 further comprising:

a switch electrically coupled to the second antenna and configured to electrically isolate the second antenna from the first antenna in an open state.

22. A multi-band wireless terminal according to claim 17:

wherein the first electromagnetic radiation comprises first electromagnetic radiation in a first frequency range within the low-band frequency range; and wherein the second electromagnetic radiation comprises second electromagnetic radiation in a second frequency range within the low-band frequency range that overlaps the first frequency range.

23. A multi-band wireless terminal according to claim 22:

wherein the first frequency range comprises about 824 MHz to about 894 MHz; and wherein the second frequency range comprises about 880 MHz to about 960 MHz.

24. A multi-band wireless terminal according to claim 17 wherein the second antenna comprises a bent monopole antenna or a planar inverted F antenna.

25. A multi-band radiotelephone, comprising:

a housing having top, intermediate, and bottom relative portions;

a first low-band antenna, located proximate to the top portion or proximate to the intermediate portion, and configured to resonate in response to first electromagnetic radiation in a low-band frequency range in an active state;

a second low-band antenna, separate from the first antenna and located proximate to the bottom portion and distal from the top portion, and configured to resonate in response to second electromagnetic radiation in the low-band frequency range in the active state; and a floating parasitic element proximate to one of the first of second antennas and ohmically isolated therefrom wherein the floating parasitic element is configured to electromagnetically couple a third electromagnetic radiation to the second antenna in a high-band frequency range that is greater than the low-band frequency range.

26. A multi-band radiotelephone according to claim 25 wherein the second antenna extends substantially parallel to a bottom edge of the radiotelephone.

27. A multi-band radiotelephone according to claim 25 wherein the second antenna extends substantially parallel to a side edge of the radiotelephone toward the top portion.

28. A multi-band radiotelephone according to claim 25 wherein the second antenna comprises a bent monopole antenna or a planar inverted F antenna.

* * * * *

UNITED STATES PATENT AND TRADEMARK OFFICE

CERTIFICATE OF CORRECTION

PATENT NO. : 7,109,924 B2
APPLICATION NO. : 10/848026
DATED : September 19, 2006
INVENTOR(S) : Vance It is certified that error appears in the above-identified patent and that said Letters Patent is hereby corrected as shown below:

Column 14,
Line 12, should read -- antenna and ohmically isolated therefrom, wherein the --

Signed and Sealed this

Twenty-third Day of January, 2007

JON W. DUDAS
*Director of the United States Patent and Trademark Office*